United States Patent [19]

McCarthy

[11] 4,138,034

[45] Feb. 6, 1979

[54] PACKAGE FOR DISCRETE PRE-MOISTENED INTERLEAVED SHEETS AND THE POP-UP DISPENSING THEREOF

[75] Inventor: Robert F. McCarthy, Cincinnati, Ohio

[73] Assignee: The Procter & Gamble Company, Cincinnati, Ohio

[21] Appl. No.: 711,929

[22] Filed: Aug. 5, 1976

[51] Int. Cl.[2] ..... A47K 10/24; B65H 1/00

[52] U.S. Cl. ..... 221/48; 221/63

[58] Field of Search ..... 221/33, 45–63; 229/17 S, 7 R; 206/494, 498, 205, 210, 233

[56] References Cited

U.S. PATENT DOCUMENTS

| | | | |
|---|---|---|---|
| 2,017,176 | 10/1935 | Andrews | 229/17 |
| 2,580,982 | 1/1952 | Weiss | 221/48 |
| 3,265,242 | 8/1966 | Davis | 221/63 |
| 3,499,575 | 3/1968 | Rockefeller | 206/205 |
| 3,726,395 | 4/1973 | Duhy | 206/46 ST |
| 3,749,296 | 7/1973 | Harrison | 225/106 |
| 3,780,908 | 12/1973 | Fitzpatrick et al. | 221/48 |
| 3,784,055 | 1/1974 | Anderson | 221/46 |
| 3,784,056 | 1/1974 | Spruyt | 221/63 |
| 3,819,043 | 6/1974 | Harrison | 204/449 |
| 3,836,045 | 9/1974 | Duhy et al. | 221/63 |
| 3,843,017 | 10/1974 | Harrison | 331/63 |
| 3,862,703 | 1/1975 | Dutcher | 221/63 |
| 3,893,566 | 7/1975 | Ross | 206/498 |
| 3,967,756 | 7/1976 | Barish | 221/45 |
| 3,973,695 | 8/1976 | Ames | 221/63 |
| 3,979,019 | 9/1976 | Bliss | 221/48 |
| 3,986,479 | 10/1976 | Bonk | 118/506 |

FOREIGN PATENT DOCUMENTS

| | | | |
|---|---|---|---|
| 1419167 | 12/1975 | United Kingdom | 221/63 |

*Primary Examiner*—Robert B. Reeves
*Assistant Examiner*—H. Grant Skaggs
*Attorney, Agent, or Firm*—Melville, Strasser, Foster & Hoffman

[57] ABSTRACT

A dispensing package for individual sheets pre-moistened with a volatile component. The package comprises a container impervious to the volatile component with a stack of the pre-moistened sheets therein in discrete, interleaved condition. One surface of the package has a restrictive dispensing orifice so sized as to just permit the passage therethrough of two of the pre-moistened sheets in tightly gathered form so that, as each sheet is pulled through the orifice, it will pull a sufficient amount of the next sheet of the stack through the orifice to be conveniently grasped by the consumer when desired and to serve as a plug for the orifice until it is extracted therefrom by the consumer. During the packaging process a sufficient portion of the topmost sheet of the stack is caused to extend beyond the opening to enable the consumer to grasp the topmost sheet and extract it without having to open the package container and pre-start the topmost sheet through the dispensing orifice. For shipment and storage of the package prior to use by the consumer, a detachable and discardable barrier seal is located over the dispensing orifice and the extended portion of the topmost sheet. The dispensing package may be provided with a covering label, overwrap, surrounding carton or the like.

9 Claims, 17 Drawing Figures

PACKAGE FOR DISCRETE PRE-MOISTENED INTERLEAVED SHEETS AND THE POP-UP DISPENSING THEREOF

BACKGROUND OF THE INVENTION

1. Field of the Invention

The invention relates to a dispensing package, and more particularly to a package for a stack of discrete, pre-moistened, interleaved sheets and for the pop-up dispensing thereof.

2. Description of the Prior Art

In recent years there has been increased interest in sheets, towelettes or tissues pre-moistened with a volatile component. The composition and purpose of the volatile component has varied widely. Non-limiting examples of such volatile components have included perfume, cleaning compound, wax, insecticide or insect repellent, topical medicaments and cosmetics.

Single, pre-moistened sheets have been individually packaged in moisture impervious foil envelopes or the like to be carried in the purse or pocket. Prior art workers have also taken a number of approaches to the packaging of pre-moistened sheets in bulk. For example, U.S. Pat. No. 3,449,575 in the name of W. G. Rockefeller, issued Mar. 10, 1970 teaches a fluid impervious tray located within a cardboard box having a hinged lid. The tray is additionally closed by a flexible sheet of moisture impervious material which is removed and discarded by the consumer. The tray contains a stack of non-interleaved, pre-moistened sheets maintained in a distorted form by a support member of triangular cross section. This distorted condition of the sheets makes them more readily removable one at a time. Once the flexible sheet of moisture impervious material has been removed from the tray, the hinged lid of the cardboard box will serve to retard evaporation of the volatile material with which the sheets in the tray have been moistened.

U.S. Pat. No. 3,726,395 in the name of K. W. Duhy, issued Apr. 10, 1973, teaches a stack of liquid saturated disposable towels located within a tray having a foil-backed paper cover sealed to the upper edge thereof. An additional removable and replaceable lid is located beneath the cover for use when the cover has been removed and discarded. Another container for a non-interleaved stack of pre-moistened towelettes is taught in U.S. Pat. No. 3,819,043, in the name of T. S. Harrison, issued June 25, 1974. In accordance with this patent, a tray is provided for the pre-moistened towelettes having a removable cover. The cover has a large dispensing opening covered by a flexible, re-sealable closure flap. In yet another approach taught by U.S. Pat. No. 3,893,566, in the name of R. G. Ross, issued July 8, 1975, a stack of pre-moistened wipers are located in a tray having a foil seal at the top and a hinged closure. The hinged closure may be opened and a part of the foil seal removed for access to the wipers. The hinged cover will thereafter be used to retard evaporation of the material with which the wipers are saturated.

Prior art workers have also employed packages having dispensing openings provided with plug-type closure means. Examples of such packages are taught in U.S. Pat. No. 3,784,055 in the name of J. R. Anderson, issued June 8, 1974 and U.S. Pat. No. 3,862,703, in the name of D. P. Dutcher, issued Jan. 28, 1975. U.S. Pat. No. 3,784,056 in the name of H. Spruyt, issued Jan. 8, 1974, teaches a moisture-impermeable package of non-interleaved, pre-moistened wipers provided with a lid having a dispensing slit therein, normally closed, but openable by distortion of the package for removal of a wiper.

Packages have also been developed wherein pre-moistened sheets are provided in the form of continuous webs with transverse lines of perforation defining each sheet. The continuous webs may be in the form of a stack or a roll. Such an arrangement is generally utilized when it is desired to dispense the sheets with a "pop-up" action (i.e. when a sheet is removed from the package, the next suceeding sheet will extend part way through the dispensing opening for ready removal).

A typical approach to such a pop-up dispenser is to provide a container having a dispensing orifice in the form of a single slit or two or more intersecting slits. Each sheet must be detached from the next along the transverse line of perforations therebetween once the transverse line of perforations has passed through the slit-type orifice. An exemplary package of this sort is taught in U.S. Pat. No. 3,749,296, in the name of T. S. Harrison, issued July 31, 1973. Generally, a package of this sort has a removable lid provided with the dispensing slits. An additional cover for the slits may also be present. It is frequently necessary for the consumer to remove the package lid and start the uppermost sheet through the dispensing slits. U.S. Pat. No. 3,843,017, in the name of T. S. Harrison, issued Oct. 22, 1974 teaches a variation of such a package wherein a triangular dispensing opening is provided having in association therewith an interior flap which substantially or completely closes the dispensing opening. The flap provides tension on the web or a tortuous path for the web so that the individual sheets of the web will tear off properly.

Yet another approach to the pop-up dispensing of pre-moistened sheets is taught in U.S. Pat. No. 3,780,908, in the name of W. E. Fitzpatrick, issued Dec. 25, 1973. In accordance with this reference, a moisture impervious container is provided for a stack of interleaved, pre-moistened sheets. The container has a lid providing a substantially moisture-proof seal between the container and the atmosphere. The container further has a barrier overlying the stack of wet sheets with a rather large diamond-shaped restricting orifice.

The present invention is based upon the discovery that if a moisture-proof package of interleaved, pre-moistened sheets is provided with a dispensing opening so dimensioned as to enable twice the cross-sectional area of a pre-moistened sheet (i.e., two pre-moistened sheets in tightly gathered form) to pass therethrough without such undue friction that would cause the sheets to jam, tear or separate before the next succeeding sheet is presented for subsequent removal, the succeeding sheet will not only be presented for subsequent removal, but in the meantime will also serve as a plug for the dispensing opening minimizing evaporation of the volatile composition with which the sheets have been pre-moistened. No additional closure or lid is required to be closed by the consumer to prevent dry-out. The package may be made in various forms. The topmost sheet of the stack may be partially inserted through the dispensing opening during the packaging process, obviating the necessity for the consumer to open the package and start the first sheet through the dispensing opening, running the risk of contaminating the contents, spilling the stack of sheets or disturbing their interleaved condition. The present invention provides a pop-up dispensing package for discrete, pre-moistened sheets which is simple in construction and more convenient in use than prior art dispensing packages.

SUMMARY OF THE INVENTION

The invention is directed to a dispensing package for individual sheets pre-moistened with a volatile component. The package comprises a container impervious to the volatile component and adapted to accommodate a stack of individual, discrete, pre-moistened sheets in interleaved condition. The top surface of the container has a restricted dispensing orifice therein. The orifice is so sized as to just permit the passage therethrough of two pre-moistened sheets in tightly gathered form and without such friction as would be inconvenient to the consumer or as would cause jamming or tearing of the sheet being extracted or separation of that sheet from the next succeeding sheet prior to complete passage of the sheet being extracted through the dispensing orifice. Under these circumstances, the sheet being extracted by the consumer will pull with it through the dispensing orifice a sufficient amount of the next succeeding sheet to enable the next succeeding sheet to be conveniently grasped by the consumer for subsequent extraction and to serve as a plug for the dispensing orifice to restrict the passage of air therethrough and to minimize evaporation of the volatile component of those sheets remaining within the container. This pop-up feature enables the dispensing of discrete sheets rather than connected perforated sheets which must be separated after the perforation line has passed through the dispensing opening and which, if separated prior to the passage of the perforation line through the dispensing opening, require that the container be opened and the topmost sheet therein be restarted through the dispensing opening.

In one embodiment, the container comprises a thin-walled tray and cover therefor which, when provided with a stack of the pre-moistened sheets, may be sealed together. The dispensing orifice is located in a depression in the cover. During the packaging process, a portion of the topmost sheet of the stack may be extended through the dispensing orifice by an appropriate mandrel means or the like. In this way, the consumer is not required to open the container and start the topmost sheet through the dispensing orifice. The depression in the container cover (and hence the dispensing orifice and the portion of the topmost sheet extending therethrough) is covered by a removable barrier layer or seal. To complete the package, the container may be provided with a label covering the upper surface of the container lid, an appropriate overwrap, or the container may be located within a carton having a pop-out portion to expose the removable seal.

In another embodiment of the package, the tray portion and cover therefor may be molded or otherwise made of thick-walled material impervious to the volatile component with which the sheets are premoistened. Again, the dispensing orifice will be located in a depression in the cover with the topmost sheet partially extended therethrough. A removable barrier layer or seal will be located over the depression. Where desired, a label or overlay may be provided over the cover and seal with a pop-out for access to the seal. The package may be provided with an additional overwrap or the like, if desired.

In yet another embodiment of the present invention the package comprises a thick-walled tray molded or otherwise fabricated of a material impervious to the volatile component with which the sheets are pre-moistened. The tray has at its upper end first and second flaps hinged to opposite sides of the tray. The free end of the first flap has a substantially V-shaped notch therein. The second flap has a substantially triangular opening therethrough. When the first flap is closed and the second flap is closed thereover, a portion of the triangular opening in the second flap overlaps a portion of the V-shaped notch in the first flap to form the dispensing orifice. The first flap may have an enlarged portion or lug which extends upwardly through a portion of the triangular opening of the second flap when the flaps are in closed position. During the packaging procedure, a portion of the topmost sheet of the stack is caused to overlie the first flap and underlie the second flap. In this way, a part of the topmost sheet is presented to the consumer at the opening in the second flap by the lug on the first flap so that the topmost sheet may be readily grapsed and extracted by the consumer resulting in the pop-up of the next sheet of the stack. Again, a removable seal or barrier layer is located over the opening in the second flap and the entire second flap may be covered by a label or like device having a pop-out portion for access to the removable seal.

BRIEF DESCRIPTION OF THE DRAWINGS

FIG. 10 is a perspective view of yet another package of the present invention.

FIG. 11 is a cross sectional, elevational view of the package of FIG. 10.

FIG. 12 is a plan view of the package of FIG. 10 with the flaps in closed position.

FIG. 13 is an elevational view of the package of FIGS. 10 through 12, partly in cross section and illustrating the first flap in closed position with a portion of the topmost sheet of the stack overlying the first flap.

DESCRIPTION OF THE PREFERRED EMBODIMENTS

Figure 1:
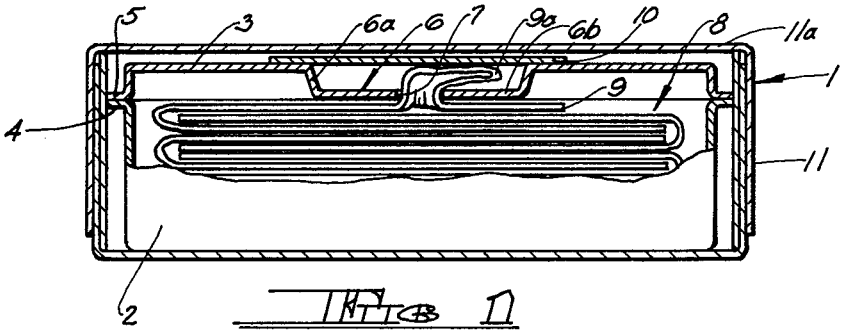
FIG. 1 is an elevational view, partly in cross section, of a dispensing package of the present invention.

The nature of the pre-moistened sheets to be dispensed does not constitute a limitation on the present invention. The sheets may be made of paper, nonwoven cloth, woven cloth, film or the like. The sheets may be pre-moistened with any appropriate volatile composition including, but not limited to, those listed above. The package of the present invention may be made of rigid or semi-rigid plastic, paperboard laminates, or combinations of paper board and film or paper board and rigid or semi-rigid plastics. The material from which the package is made will depend upon the nature of the volatile compound with which the sheets are pre-moistened and should be compatible therewith and impervious thereto.

An exemplary package is illustrated in FIGS. 1 through 5 wherein like parts have been given like index numerals. The package is generally indicated at 1 and comprises a rectangular tray 2 and a cover member 3. The tray and cover member, in this instance, are thin-walled, having been molded from semi-rigid plastic. Exemplary plastic materials which may be used include polyethylene, polypropylene and polystyrene. The tray 2 has about its upper edge a laterally extending peripheral flange 4. The cover 3 has a mating peripheral flange 5. Once a stack of sheets has been located within the tray, the cover 3 will be located thereon and the flanges 4 and 5 will be heat or adhesively sealed, depending upon the nature of the material from which the tray 2 and cover 3 are molded. It is also within the scope of the invention to have the flanges 4 and 5 along one side of the tray and cover constitute an integral hinge, as is well known in the art.

The upper surface of the cover 3 has a depression (generally indicated at 6) formed therein. The configuration of the depression 6 does not constitute a limitation. For purposes of an exemplary showing, the depression is illustrated as being circular with an annular inwardly and downwardly sloping wall 6a and a substantially planar bottom 6b (see FIGS. 4 and 5).

A dispensing orifice 7 is located in the bottom 6b of depression 6. While illustrated as being circular (see FIGS. 4 and 5), and while it is preferred that the dispensing orifice be circular or oval, it nevertheless may be of any appropriate configuration. The size of dispensing orifice 7, however, is critical. The orifice should be so sized as to permit twice the cross sectional area of a pre-moistened sheet (i.e., two pre-moistened sheets in tightly gathered form) to pass therethrough. It will be understood that this refers to the cross sectional areas of the sheet being extracted from the package and of the next succeeding sheet being pulled to pop-up position. The orifice 7 should be so sized that the force required to pull a tightly gathered double thickness of the sheets therethrough is not so great as to be inconvenient to the consumer. The tightly gathered double thickness of the sheets should pass through the orifice 7 without such undue friction as would cause the sheets to jam, tear or as would cause the sheets to separate until the sheet being extracted has cleared the orifice. Thus, the orifice size will be selected to achieve maximum restriction and still maintain easy dispensing, depending on the orifice wall texture, the texture of the pre-moistened sheets and the lubricating properties of the volatile compound with which the sheets are pre-moistened.

With these factors in mind, the skilled worker in the art can readily determine an appropriate orifice size for the particular size and nature of the sheets desired to be dispensed. For example, excellent results were achieved with a package of the type illustrated in FIGS. 1 through 5 having cover formed of polypropylene 0.020 inch thick. The cover had a circular dispensing orifice 7 with a 3/16 inch diameter (i.e., an opening area of 0.0276 square inch). The sheets were of nonwoven rayon 2.5 inches wide and 0.005 inch thick (i.e., a cross sectional area of 0.0125 square inch, two sheets having a total cross sectional area of 0.025 square inch). The volatile compound with which the sheets were pre-moistened was a light oil. The sheets were extracted through the dispensing orifice in the machine direction of the sheets.

When a given sheet is extracted from orifice 7 a sufficient amount of the next succeeding sheet will be drawn through the orifice so that it may conveniently be grasped and extracted by the consumer at a later time. Thus the orifice 7 permits pop-up dispensing of discrete sheets. In addition, that portion of each sheet which is pulled through the orifice 7 in gathered form by the previously extracted sheet will serve as a plug for the orifice, minimizing dry-out of the remainder of the sheets within the tray 2 without necessitating an additional resealable flap, hinged cover or plug-type closure for the package. Thus, the package 1 provides a means for reliably dispensing individual wet sheets while protecting the reserve sheets from evaporation of the volatile composition with which they have been pre-moistened.

In FIG. 1, a stack of pre-moistened sheets is generally indicated at 8. The individual sheets of the stack are identical and are illustrated as being interfolded or interleaved with alternating "V" folds. The sheets may be otherwise interleaved, as for example by means of a conventional "Z" fold.

In FIG. 1, the topmost sheet 9 is shown as having a portion *9a* extending through dispensing orifice 7. This may be accomplished during the packaging process and prior to attachment of cover 3 to tray 2 in any suitable manner, as through the use of mandrel means or the like. The portion *9a* of topmost sheet 9 is located within the depression 6 of cover 3 and, as will be described hereinafter, provides a means whereby the consumer may extract the topmost sheet.

Prior to use by the consumer and during storage and shipment, a detachable and discardable barrier layer or seal 10 may be adhered to the top surface of cover 3 over depression 6, dispensing orifice 7 and the portion *9a* of topmost sheet 9. The detachable barrier layer or seal 10 may be made of any appropriate material including a plastic film, a metal foil, a paper backed metal foil, or the like, all as is well known in the art. The selection of an appropriate barrier layer or seal should depend upon the nature of the composition with which the sheets are pre-moistened and whether the barrier layer must serve as a moisture barrier, a gas barrier or both.

In instances where the tray 2 and cover 3 are thin-walled structures molded of semi-rigid plastic or the like, it may be desired to locate the tray and cover assembly within an outer carton. In FIG. 1 a full flap paperboard carton is illustrated at 11. The precise nature of the carton and the material from which it is formed do not constitute limitations on the present invention.

Preferably carton 11 is so sized as to just nicely accommodate the tray 2 and cover 3. For purposes of clarity, the barrier layer or seal 10 is exaggerated in thickness. The carton is so sized that its upper surface 11*a* will closely overlie the top surface of cover 3.

Figure 2:
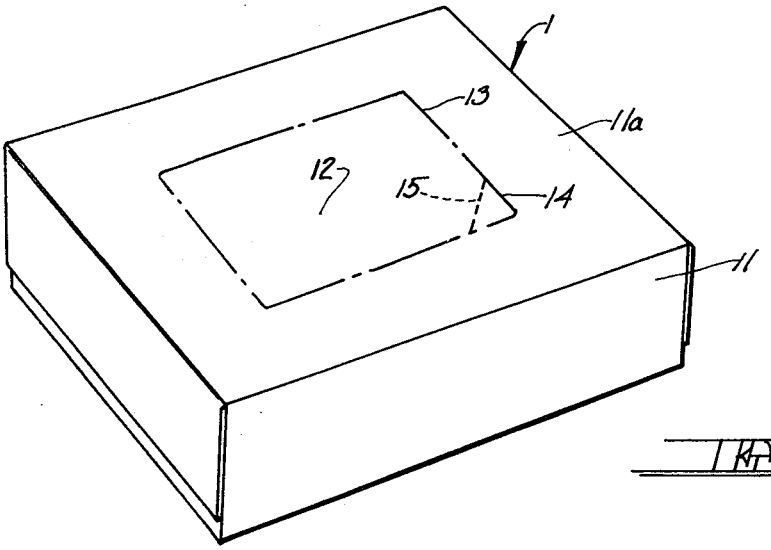
FIG. 2 is a perspective view of the package of FIG. 1.

As is shown in FIG. 2, the upper surface 11*a* of carton 11 is provided with a pop-out panel 12, or other appropriate detachable portion. For purposes of an exemplary showing, the pop-out panel 12 is defined by a line of perforations 13. One corner of the panel 12 may be fully cut, as at 14, and provided with an adjacent fold line 15. It is therefore only necessary for the consumer to insert a fingernail or other implement beneath corner 14, fold the corner upwardly and use it as a pull tab to detach the entire panel 12.

Figure 3:
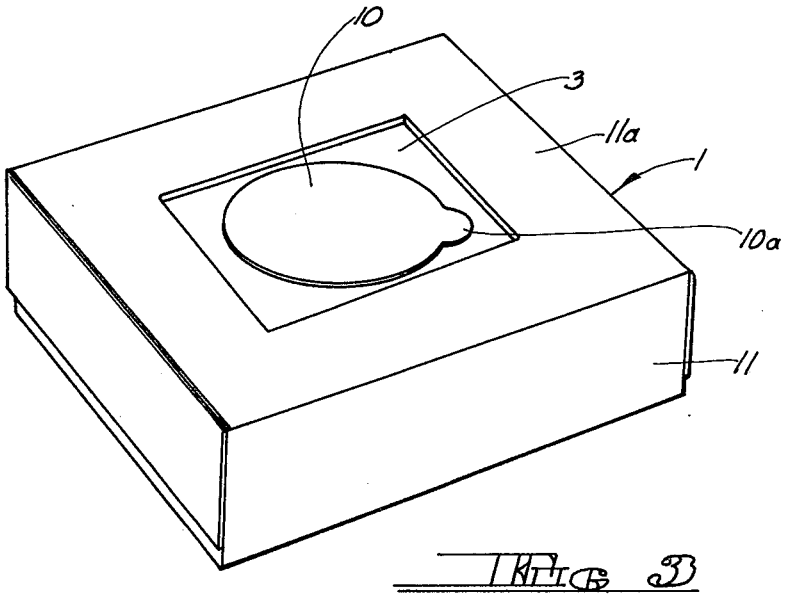
FIG. 3 is a perspective view similar to FIG. 1 with the pop-out portion of the package removed to expose the removable seal or barrier layer.

FIG. 3 illustrates the package 1 with the pop-up panel 12 removed. As is shown, the barrier layer or seal 10 is exposed for removal by the consumer. The configuration of the seal 10 does not constitute a limitation on the present invention. For purposes of an exemplary showing, it is illustrated as having a pull tab 10*a* by which it may be detached from the upper surface of cover 3.

Figure 4A:
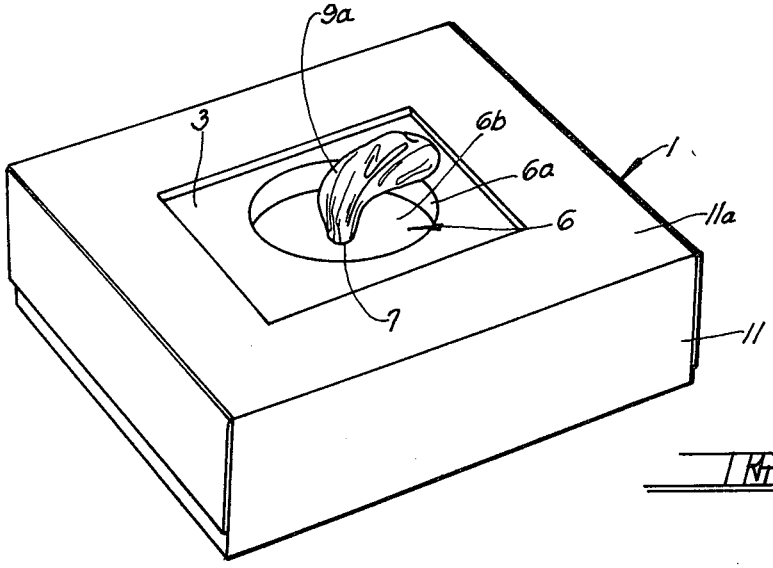
FIG. 4 is a perspective view similar to FIGS. 2 and 3 but with the barrier layer or seal removed to expose the dispensing orifice and a portion of the topmost sheet of the stack.
Figure 5:
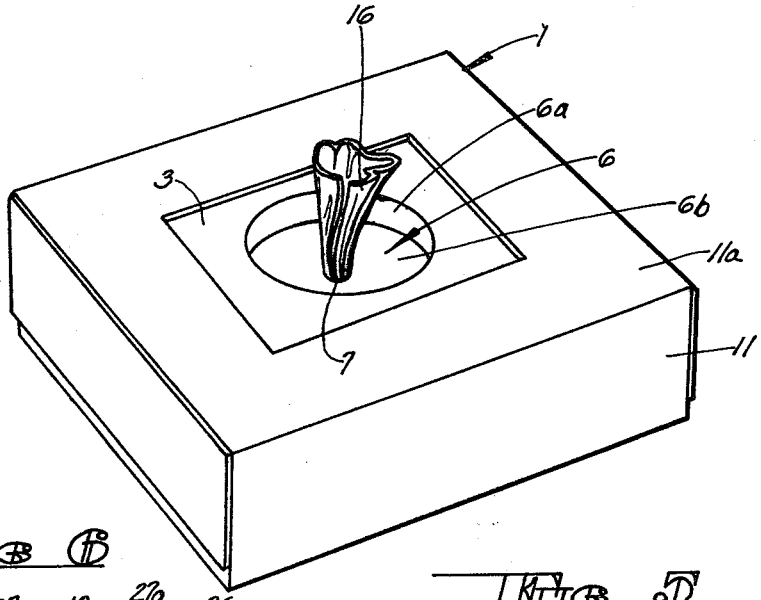
FIG. 5 is a perspective view similar to FIG. 4 and illustrating the second sheet of the stack in pop-out condition after extraction of the first sheet.

In FIG. 4 the package 1 is shown with both the panel 12 and seal 10 removed, exposing the portion 9*a* of topmost sheet 9 extending through dispensing orifice 7. The depression 6 is so sized and the sheet portion 9*a* is of such length that it may be readily grasped and extracted from dispensing orifice 7 by the fingers of the consumer. Extraction of the topmost sheet 9 will, as indicated above, result in the pop-up of a portion of the next succeeding sheet. This is illustrated at 16 in FIG. 5. The sheet portion 16 is ready for subsequent extraction by the consumer and, in the meantime, serves to plug the dispensing orifice 7 to prevent dry-out of the remaining sheets of the package.

Figure 6:
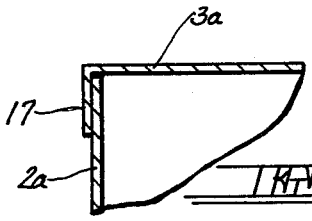
FIG. 6 is a fragmentary cross sectional view illustrating a modification of the tray and cover portion of the package.

As mentioned above, the cover 3 may be attached to the tray 2 in any appropriate manner. In FIG. 6, a tray 2*a* is fragmentarily illustrated together with a cover 3*a*. Tray 2*a* and cover 3*a* may be identical to tray 2 and cover 3 of FIG. 1 with the exception that tray 2*a* does not have a laterally extending flange 4 and cover 3*a* is provided with a downwardly depending peripheral skirt 17 adapted to engage the upper edge of the tray. The engagement of the tray by skirt 17 may be a frictional one. In instances where additional sealing is required, the skirt 17 may be heat or adhesively sealed to the tray, depending upon the materials from which the tray 2*a* and cover 3*a* are molded.

Figure 7:
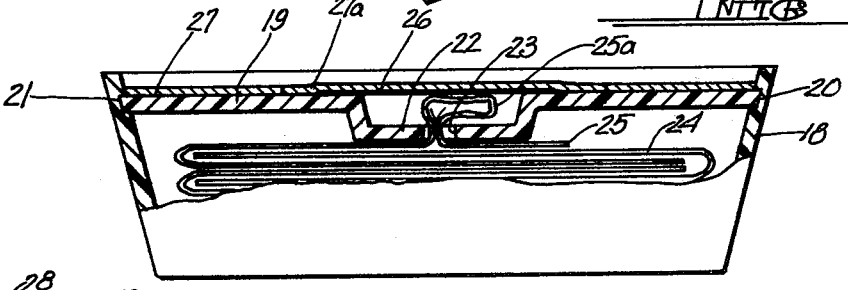
FIG. 7 is an elevational view, partly in cross section, of another embodiment of the package of the present invention.
Figure 8:
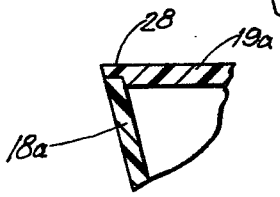
FIGS. 8 and 9 are fragmentary cross sectional views illustrating modifications of the package of FIG. 7.
Figure 9:
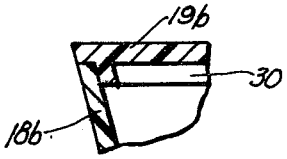
Figure 1D:
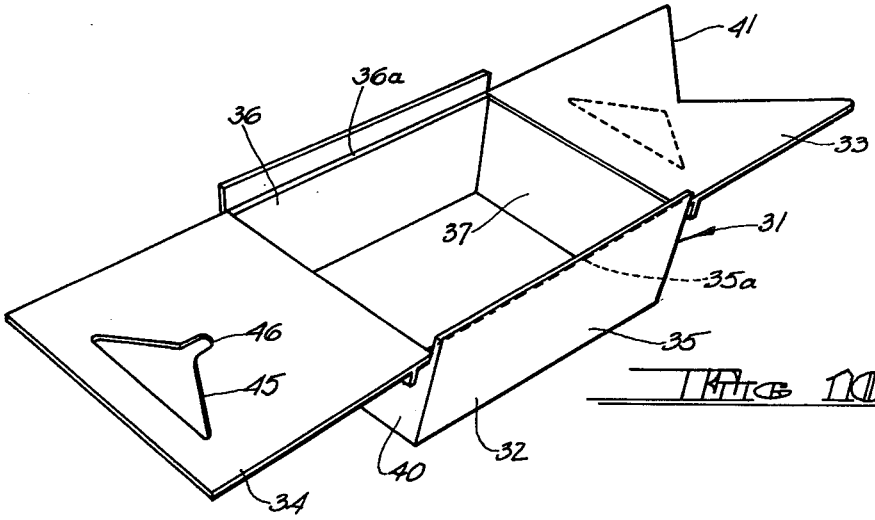
Figure 1E:
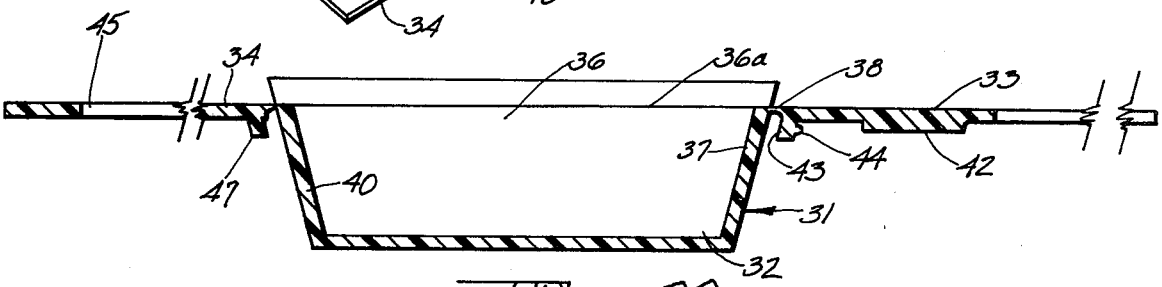
Figure 1F:
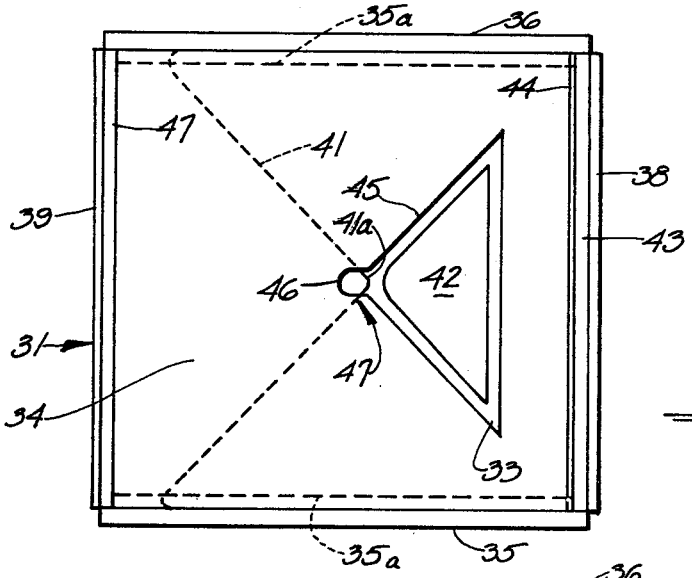
Figure 3:
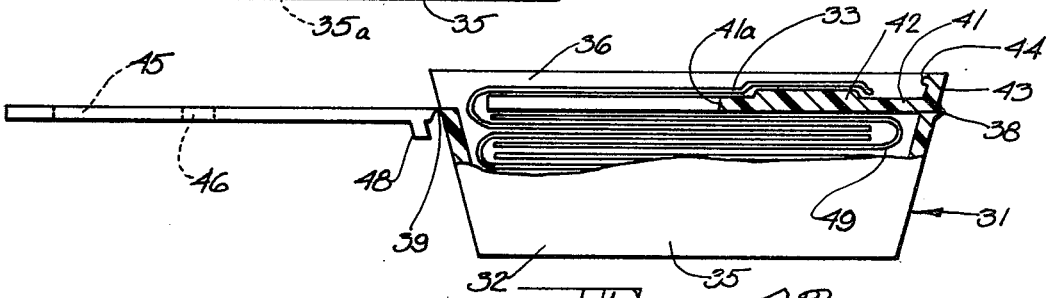

FIGS. 7 through 9 illustrate a modification of the package of FIGS. 1 through 6. In this instance, the package comprises a thick-walled tray 18 and cover 19 molded of rigid plastic. The cover 19 is attached to tray 18 by engagement of its peripheral edges in notches formed in the side walls of tray 18 (two such notches being shown at 20 and 21).

Cover 19 is provided with a depression 22 equivalent to the depression 6 of FIG. 1 and containing a dispensing orifice 23 equivalent to orifice 7 of FIG. 1. A stack 24 of interleaved sheets (similar to stack 8 of FIG. 1) is located within tray 18. Again, during the packaging process, a portion 25*a* of the topmost sheet 25 of the stack is extended through dispensing orifice 23 for ready extraction by the consumer. A removable barrier layer or seal 26 is affixed to the upper surface of cover 19 to serve the same purpose as seal 10 of FIGS. 1 and 3.

Since the cover 19 is slightly recessed within the confines of tray 18, an additional overlay 27 may be provided covering the top surface of cover 19 and seal 26. The overlay 27 may be made of any suitable material including paper board or the like and may be provided with a pop-out panel similar to panel 12 of FIG. 2. The overlay may be appropriately adhered to the top surface of cover 19. Alternatively, the overlay may simply be frictionally engaged with the upper edge portions of tray 18 for total removal (by means of a tape tab or the like) by the consumer.

The cover 19 may be attached to the tray 18 by other means. In FIG. 8, for example, a tray 18*a* is fragmentarily illustrated together with a cover 19*a*. In this instance, the cover 19*a* is provided with a peripheral notch 28, adapted to receive the uppermost edge of tray 18*a*. Another alternative approach is illustrated in FIG. 9. In this instance, a tray 18*b* is fragmentarily shown together with the cover 19*b*. The cover 19*b* is provided with a downwardly depending flange 30. The cover 19*b* overlies the upper edge of tray 18*b* and the inside surface of the tray is frictionally engaged by the cover flange 30.

In the alternative exemplary constructions illustrated in FIGS. 8 and 9 the engagement between the cover and the tray may be a simple interference or frictional one. It is also within the scope of the invention to permanently attach the cover to the tray by any appropriate means, depending upon the materials from which the parts are made, including heat sealing, adhesive attachment or the like. Such permanent attachment will additionally seal the cover to the tray to prevent escape of the volatile composition with which the sheets are saturated.

Another embodiment of the package of the present invention is illustrated in FIGS. 10 through 17, wherein like parts have been given like index numerals. Turning first to FIGS. 10 and 11, the package is generally indicated at 31 and comprises a rigid, molded plastic structure having a tray portion 32, a hinged first flap 33 and a hinged second flap 34. Flaps 33 and 34 constitute a cover for tray portion 32. While tray 32 is illustrated as being substantially square, this is not intended to be limiting.

Opposite side walls 35 and 36 of tray 32 are configured to provide longitudinally extending shoulders 35*a* and 36*a*, respectively, to serve as supports for flaps 33 and 34, as will be described hereinafter. The first flap 33 is hinged to side wall 37 and, as shown at 38 in FIG. 11 the hinge is preferably an integral, one-piece part of side wall 37 and flap 33. In similar fashion, flap 34 is hinged as at 39 to side wall 40 of tray 32.

Flap 33 is of a length less than the distance between tray walls 37 and 40 (see FIG. 12). The free end of flap 33 is provided with a "V-shaped" notch 41. The flap 33 also carries on its upper surface an integral upstanding lug 42. The purpose of notch 41 and the purpose of lug 42 will be set forth hereinafter. The upper surface of flap 33 also has an upstanding transverse wall 43 which, when the flap is in closed condition, forms a continuation of tray wall 37 (see FIGS. 12 and 13). The wall 43 bears a locking tab 44. The locking tab may extend the full length of wall 43 or it may comprise one or more short tabs in alignment. The purpose of locking tab 44 will be evident hereinafter.

Flap 34 is of a length substantially equivalent to the distance between walls 37 and 40 of tray 32. Flap 34 is provided with a substantially triangular perforation 45 having a short, rounded extension as at 46. The upper surface of flap 34 also has a transversely extending ridge or wall 47 adapted to constitute a continuation of wall 40 when the flap is in closed position (see FIGS. 12 and 15).

The package 31 is so constructed that when flap 33 is closed it will rest upon the shoulders 35*a* and 36*a* of sides 35 and 36. Thereafter, the flap 34 may be pivoted to its closed position wherein it overlies flap 33 and is locked in place by a snap engagement with locking tab 44. This is illustrated in FIG. 12. Locking tab 44 thus constitutes means to maintain flaps 33 and 34 in their closed position. When the flaps 33 and 34 are in their closed position it will be noted that the rounded bottom 41*a* of notch 41 of flap 33 will cooperate with the rounded extension 46 of perforation 45 in flap 34 to form a dispensing orifice sized in the manner described with respect to dispensing orifice 7 of FIG. 1. It will further be noted that the lug 42 of flap 33 lies within the perforation 45 of flap 34 and has a similar but smaller peripheral configuration.

Figure 14A:
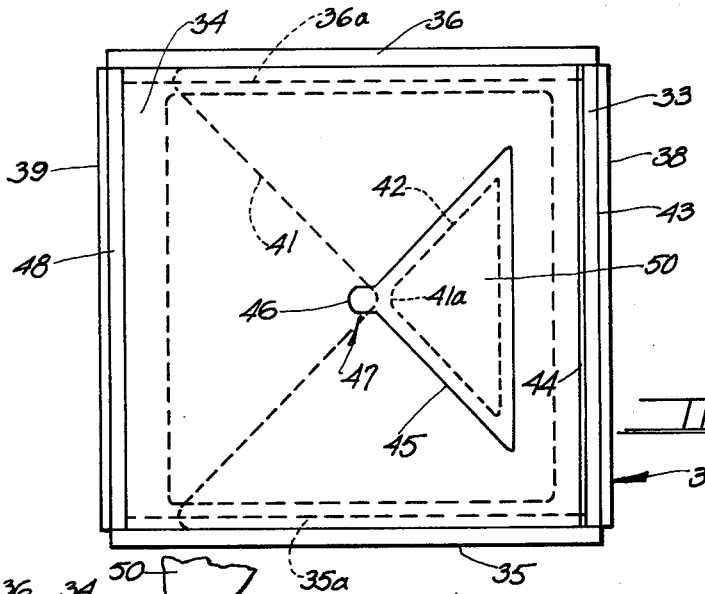
FIG. 14 is a plan view similar to FIG. 12 and illustrating the topmost sheet as presented to the consumer.
Figure 15:
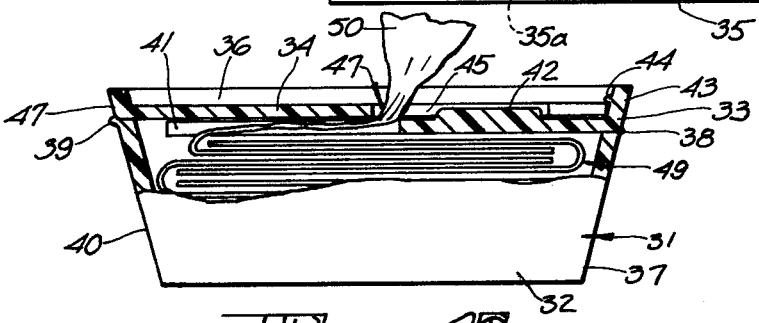
FIG. 15 is an elevational view, partly in cross section, and illustrating the topmost sheet partially removed from the package.

The manner in which the dispensing package 31 functions will be described with respect to FIGS. 13 through 15 wherein like parts have again been given like index numerals. During the packaging process, a stack of interleaved sheets (generally indicated at 48 and similar to the stack 8 of FIG. 1) is located within the tray 32. The flap 33 is pivoted to its closed position and a part of the uppermost sheet 49 of stack 48 is caused to overlie flap 33, as shown in FIG. 13. At this point, flap 34 is pivoted to its closed and locked position as illustrated in FIG. 14. It will be evident from FIG. 14 that that portion of topmost sheet 49 overlying flap 33 will be exposed in the perforation 45. By virtue of lug 42 of flap 33 the exposed portion of top sheet 49 is presented to the consumer for easy grasping. As the exposed portion is pulled upwardly by the consumer the substantially triangular opening 45 will serve as a gathering angle directing that portion of the topmost sheet 50 toward the dispensing orifice 47. Similarly, the remainder of topmost sheet 50 and that interleaved portion of the next sheet will be gathered toward dispensing orifice 47 by the "V-shaped" notch 41 of flap 33, serving as another gathering angle. This is illustrated in FIG. 15 wherein the topmost sheet 50 has been partially removed from the package 31. The "V-shaped" notch 41 of flap 31 will serve as a gathering angle for all of the sheets within tray 32 and will assure the pop-up feature. It will be understood that once sheet 50 is extracted from package 31, the next succeeding sheet will partially extend through the dispensing orifice 47 for easy removal therefrom and to serve as a plug in the same manner described with respect to the embodiment of FIGS. 1 through 6.

Figure 16:
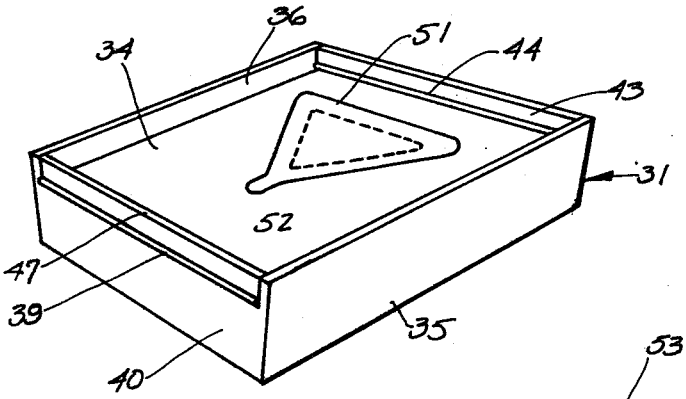
FIG. 16 is a perspective view of the package with a seal or barrier layer overlying the opening in the second flap thereof.

For storage and shipment prior to use by the consumer, the upper surface of flap 34 may have affixed thereto a removable barrier layer or seal 51 (see FIG. 16). The seal 51 is intended to serve the same purpose as seal 10 of FIGS. 1 and 3 and may be made in the same manner and similarly adhered to flap 34. For purposes of an exemplary showing only, the seal 51 is illustrated in FIG. 16 as having a pull tab 52 by which it may be readily removed.

The package 31 may be provided with any appropriate overwrap, surrounding carton or the like. However, since the package 31 is molded of rigid plastic, only a sealing means such as seal 51 is required to make the package complete.

Figure 17:
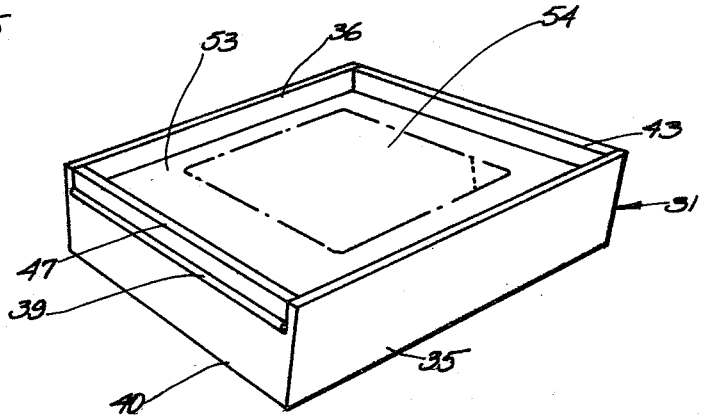
FIG. 17 is a perspective view, similar to FIG. 16 illustrating an label or overlay with a pop-out portion for access to the seal or barrier layer.

Since the flaps 33 and 34 lie below the top edges of sides 35 and 36 and the sides 37 and 40 are brought to substantially the same height by ridges 43 and 47 on flaps 33 and 34, respectively, it is possible to provide the package 31 with an overlay of paper board or the like similar to overlay 27 of FIG. 7. Such an overlay is shown at 53 in FIG. 17, provided with a pop-out panel 54 substantially identical to pop-out panel 12 of FIG 2. The overlay 53 may be adhered to the upper surface of flap 34 after that flap has been closed and provided with barrier layer or seal 51. When the pop-out panel 54 is removed, the seal 51 will be exposed for removal by the consumer. Alternatively, the overlay 53 may be held in place mechanically by integral tabs (not shown) on ridges 43 and 47, or the like. In this instance, the entire overlay may be provided with a tape tab or other device well known in the art so that it may be removed in toto.

In the embodiment described with respect to FIGS. 10 through 17, the dispensing orifice 47 need not be circular (as shown) so long as it is properly dimensioned, as described above. The V-shaped notch 41 in flap 33 need not be straight sided, so long as its edges nevertheless coverage toward dispensing orifice 47 to serve as a gathering angle. Similarly, the opening 45 in flap 34 need not necessarily be triangular. It could, for example, be oval or circular, so long as that portion of the opening adjacent the opening extension 46 converges toward the dispensing orifice, again to serve as a gathering angle. The lug 42 on flap 33 may have any appropriate configuration so long as it will be accommodated by the perforation 45 in flap 34.

In all of the embodiments of the package of the present invention, the tray and cover portions may have shapes other than square. It is desirable that the tray be relatively shallow so that the distance between the sheets within the tray and the dispensing orifice will be sufficiently limited to assure that each extracted sheet will result in the pop-up of the next sheet. In instances where it is desired to accommodate a large stack of sheets, a follower (of any type well known in the art) may be provided in the bottom of the tray to maintain an appropriate distance between the top of the stack and the dispensing orifice to assure reliable dispensing.

Modifications may be made in the invention without departing from the spirit of it.

The embodiments of the invention in which an exclusive property or privilege is claimed are defined as follows:

1. A dispensing package and a plurality of sheets pre-moistened with a volatile compound and so arranged in said package that each sheet to be dispensed is discrete from the next succeeding sheet to be dispensed and when dispensed will carry said next succeeding sheet to a dispensing position, said package comprising a tray containing said sheets and a cover for said tray, said cover comprising a pair of opposed first and second flaps hingedly attached to said tray, said first flap being swingable between an open position and a closed position overlying said tray, said first flap having a free end with a substantially V-shaped notch formed therein, said second flap being swingable between an open position and a closed position overlying said tray and said first flap, said second flap having an opening formed therein, means to maintain said flaps in their closed positions, a portion of said opening of said second flap overlapping said V-shaped notch of said first flap to form a dispensing orifice when said flaps are in their closed positions, said dispensing orifice being so dimensioned as to just permit two of said pre-moistened sheets in tightly gathered form to be manually drawn therethrough, whereby when each sheet is manually extracted from said tray through said dispensing orifice it will pull a sufficient amount of the next succeeding sheet through said dispensing orifice to enable manual extraction thereof and to serve as a plug for said dispensing orifice to minimize dry-out of the remaining sheets within said tray.

2. The structure claimed in claim 1, including an interleaved stack of said individual pre-moistened sheets within said tray, a portion of said topmost sheet overlying said first flap and underlying said second flap and being exposed through said opening in said second flap.

3. The structure claimed in claim 2 including a detachable sealing means constituting a barrier layer for said volatile compound and being attached to said second flap overlying said opening therein.

4. The structure claimed in claim 3 including an upstanding lug on said first flap extending into said opening of said second flap when said first and second flaps are in their closed positions, said portion of said topmost sheet overlying said lug.

5. The structure claimed in claim 3 including an overlay overlying said second flap and said detachable sealing means, means to maintain said overlay in position, a portion at least of said overlay being removable to expose said detachable sealing means.

6. The structure claimed in claim 1 including a detachable sealing means constituting a barrier layer for said volatile compound and being attached to said second flap overlying said opening therein.

7. The structure claimed in claim 6 including an overlay overlying said second flap and said detachable sealing means, a portion at least of said overlay being removable to expose said detachable sealing means.

8. The structure claimed in claim 1 wherein said opening in said flap is substantially triangular, one corner of said triangular opening comprising said portion overlapping said V-shaped notch of said first flap to form said dispensing orifice.

9. The structure claimed in claim 1 wherein said tray and said first and second flaps comprise an integral one-piece structure molded of rigid plastic material compatible with and impervious to said volatile compound.

* * * * *

UNITED STATES PATENT AND TRADEMARK OFFICE

CERTIFICATE OF CORRECTION

PATENT NO. : 4,138,034

DATED : February 6, 1979

INVENTOR(S) : Robert F. McCarthy

It is certified that error appears in the above–identified patent and that said Letters Patent are hereby corrected as shown below:

Column 1, line 25, "U. S. Pat. No. 3,449,575" should read -- U. S. Pat. No. 3,499,575 --.

Column 4, line 38, "pop-out" should read -- pop-up --.

Column 9, line 45, "flap 31" should read -- flap 33 --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*